US007836647B2

(12) United States Patent
Dauron

(10) Patent No.: US 7,836,647 B2
(45) Date of Patent: Nov. 23, 2010

(54) FILTERING WALL FOR EXPENDABLE FORMS, MEANS AND PROCESS FOR MAKING SAID FILTERING WALL AND FORMS EQUIPPED WITH SAME

(76) Inventor: Francoise Dauron, 740 Place Fortier #1210, Montreal, Quebec (CA) H4L 5A9

( * ) Notice: Subject to any disclaimer, the term of this patent is extended or adjusted under 35 U.S.C. 154(b) by 1726 days.

(21) Appl. No.: 11/029,739

(22) Filed: Jan. 3, 2005

(65) Prior Publication Data

US 2005/0184414 A1 Aug. 25, 2005

(51) Int. Cl.
*E02D 27/32* (2006.01)

(52) U.S. Cl. ..... 52/292

(58) Field of Classification Search ..... 52/292; 139/194

See application file for complete search history.

(56) References Cited

U.S. PATENT DOCUMENTS

| | | | | |
|---|---|---|---|---|
| 1,684,195 | A | | 9/1928 | Olmsted |
| 2,389,238 | A | | 11/1945 | Phillips |
| 3,347,007 | A | | 10/1967 | Hale |
| 3,559,355 | A | | 2/1971 | Day |
| 3,721,058 | A | | 3/1973 | Dewey, Jr. et al. |
| 3,726,950 | A | * | 4/1973 | Turzillo ..... 264/32 |
| 4,104,842 | A | | 8/1978 | Rockstead et al. |
| 4,154,061 | A | * | 5/1979 | Umemoto et al. ..... 405/19 |
| 4,336,676 | A | | 6/1982 | Artzer |
| 4,385,648 | A | * | 5/1983 | Bindhoff ..... 139/384 R |
| 4,506,611 | A | * | 3/1985 | Parker et al. ..... 112/80.01 |
| 5,091,247 | A | * | 2/1992 | Willibey et al. ..... 442/46 |
| 5,398,470 | A | | 3/1995 | Ritter et al. |
| 5,528,876 | A | | 6/1996 | Lu |
| 5,687,522 | A | | 11/1997 | Durand et al. |
| 6,056,479 | A | * | 5/2000 | Stevenson et al. ..... 405/302.7 |
| 6,231,024 | B1 | | 5/2001 | Kugimiya et al. |
| 6,295,770 | B1 | | 10/2001 | Sheu et al. |

* cited by examiner

*Primary Examiner*—Richard E Chilcot, Jr.
*Assistant Examiner*—Andrew J Triggs

(57) ABSTRACT

The invention concerns a filtering wall designed for an expendable formwork comprising a lattice formed by assembling flexible warp and weft yarns, the lattice being stretched on an undeformable structure. The filtering wall is characterized in that some of the warp yarns are more resistant than other warp yarns, the lattice being stretched by traction solely exerted on the more resistant warp yarns and in that it comprises tension maintaining means for maintaining the tension associating the more resistant yarns with the undeformable structure, the tension maintaining means delimiting a larger mesh than the one resulting from the initial interlacing of the warp and weft yarns.

9 Claims, 6 Drawing Sheets

Figure 2:
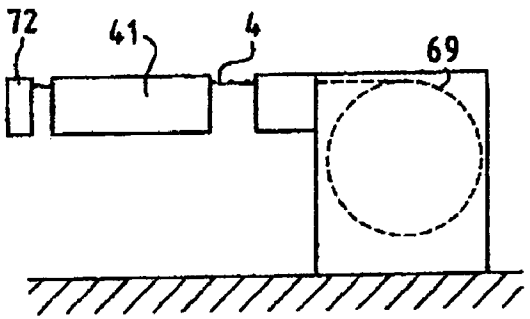

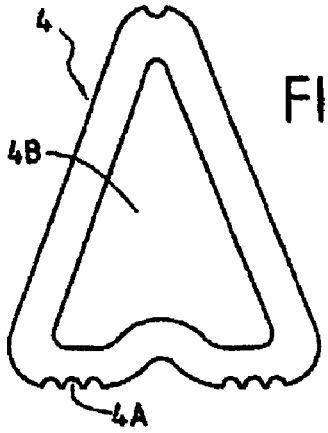
FIG.6
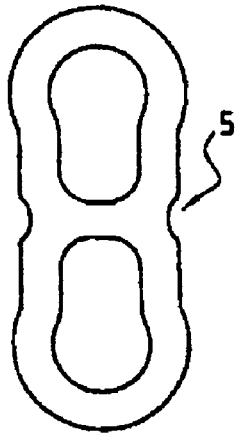
FIG.7
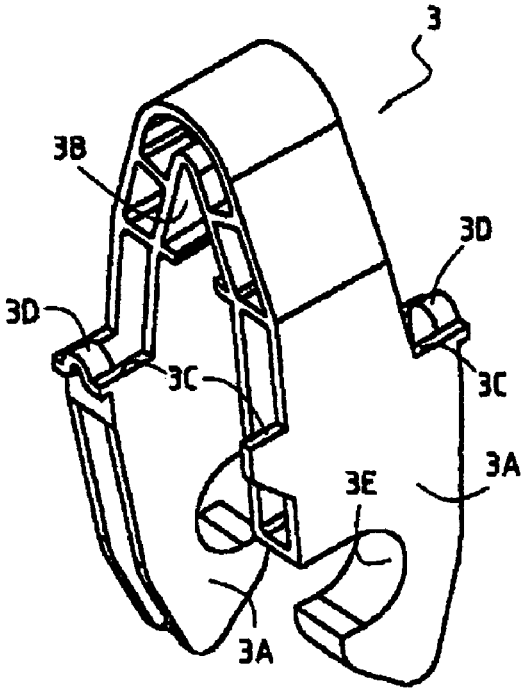
FIG.5
FIG.9
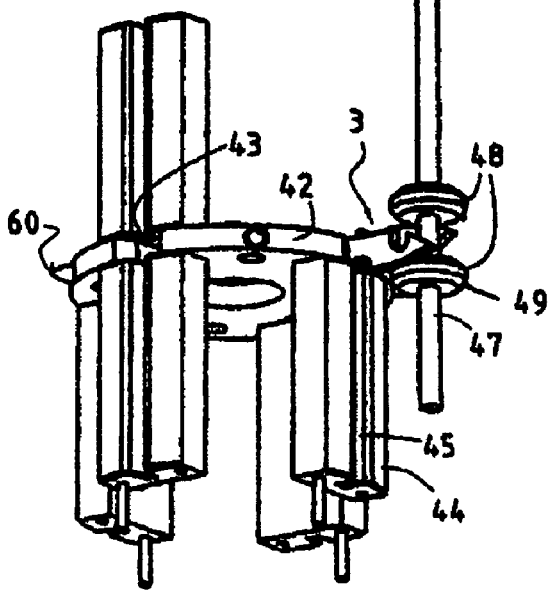

FILTERING WALL FOR EXPENDABLE FORMS, MEANS AND PROCESS FOR MAKING SAID FILTERING WALL AND FORMS EQUIPPED WITH SAME

This application claims priority based on french patent application FR 03/02029 filed Jul. 4, 2002 and PCT application WO 2004/005639 A1 filed Jul. 4, 2003.

FIELD OF THE INVENTION

The invention concerns a filtering wall for expendable forms.

It also concerns forms equipped with the filtering wall as well as the fabrication process.

It also concerns the means of fabricating the filtering wall.

BACKGROUND OF THE INVENTION

Two types of forms are used to construct concrete work.

The first type is comprised of reusable forms that form a rigid watertight pocket that concrete is poured into.

Steel sheets attached to a bearing structure form the liner walls.

This type of form presents several disadvantages, including:

- forms that are quite heavy in order to resist the hydrostatic forces,
- the custom of using fast-set concretes whose resistance stresses exceed requirements, etc.

In order to resolve these different problems, the second type of form appeared, namely expendable forms with filtering walls.

The concept of these filtering walls was developed to create different products (FR-A-2.675.181 et FR-A-2.647.839).

In particular, these filtering walls can be used to reduce the weight of forms.

The "form/filling" composite presents improved mechanical properties compared to a shell made by traditional means.

The first forms primarily used metal installed to create the desired permeability in the liner skin.

To create the liner skin on a form wall, several metal plates have to be installed to obtain the desired surface.

In addition, in these types of form, since part of the metal structure is not covered by a regulatory coating, it presents long-term durability risks.

Consequently, the structural calculations cannot take the metal structure into account.

In addition, the installed metal skin, even when protected against corrosion, can lead to damage due to corrosion phenomena.

In order to compensate for these disadvantages, there is an expendable form with a filtering skin (FR-A-2.800.109) that, in place of the installed metal, uses a mesh or fabric with wide panels obtained by interlacing warp and weft strands.

The size of the mesh panels is determined by the aggregates and desired filtering.

According to this solution, since the mesh is flexible when it is attached to the form's reinforcement, it is stretched in the two perpendicular directions to obtain uniform tension in the warp and weft strands in both directions.

In addition, spacers keep the liner skin away from the reinforcement.

The disadvantage of this type of form is that it over-consumes mesh and positions the mesh such that it hinders filling the form.

In effect, part of the mesh penetrates into the volume to be filled, which poses a problem.

SUMMARY OF THE INVENTION

The invention aims to resolve the aforementioned disadvantages.

To this end, the invention concerns a filtering wall for an expendable form comprised of a mesh formed by assembling flexible warp and weft yarns, said mesh being stretched on a so-called shape-retaining structure and the filtering wall being characterized in such a way that:

- some of the warp strands are more resistant than the other warp strands, the mesh being tensioned by traction exerted solely on said more resistant warp strands, and
- it includes tension-maintaining means that associate the more resistant strands with the shape-retaining structure, said tension-maintaining means delimiting a larger panel than the one resulting from the initial interlacing of the warp and weft strands.

The invention also concerns a form equipped with a liner wall and the means of fabricating the said liner wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE INVENTION

Figure 1:
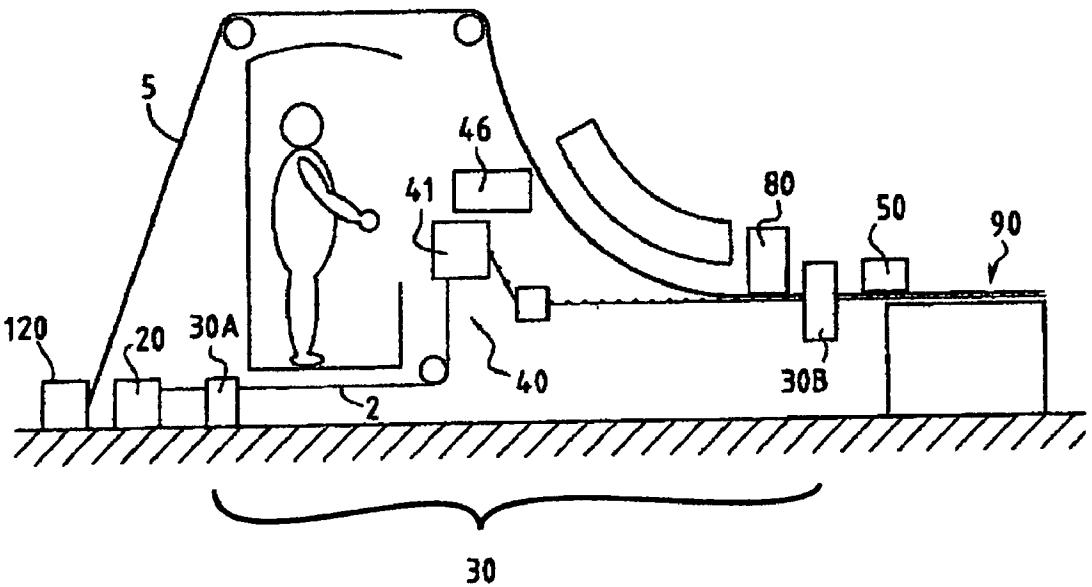
Figure 3:
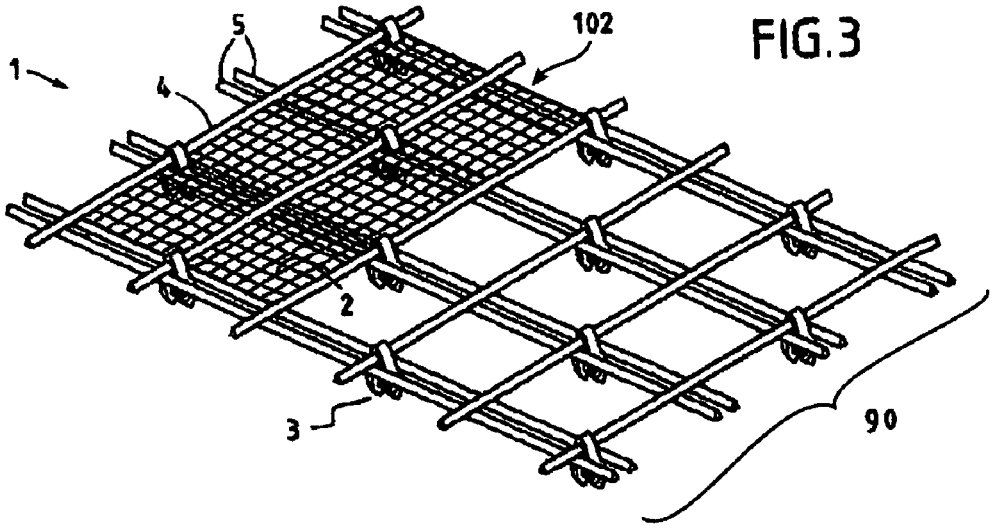
Figure 8:
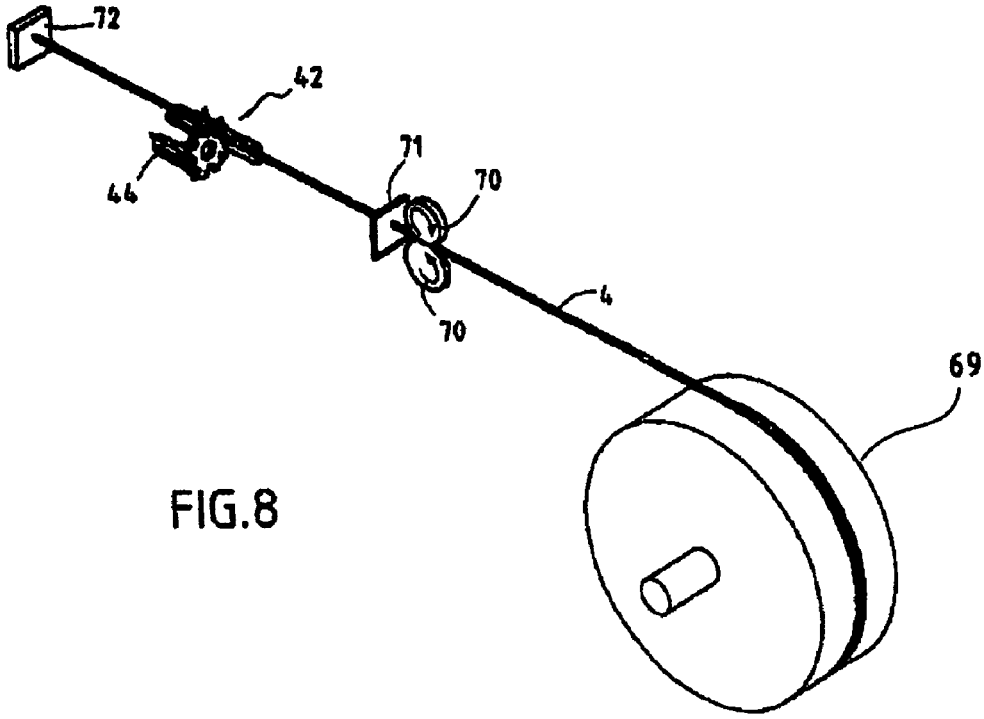
Figure 4:
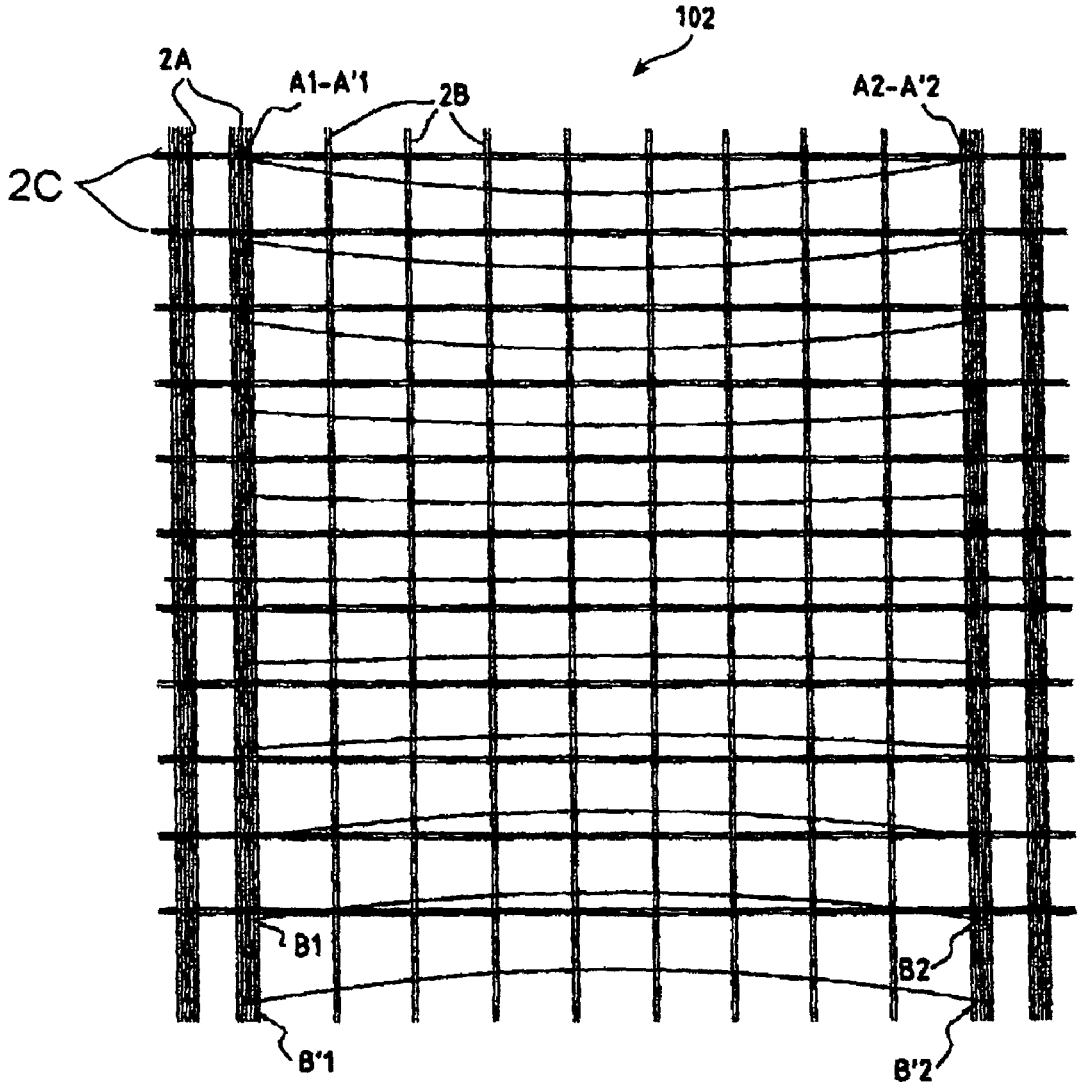
Figure 10:
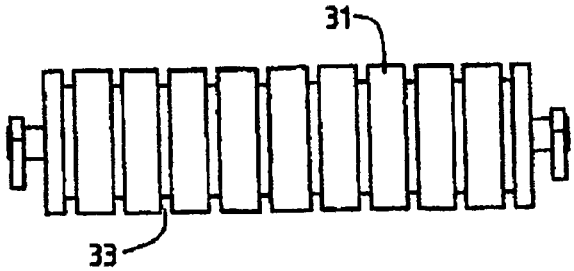
Figure 11:
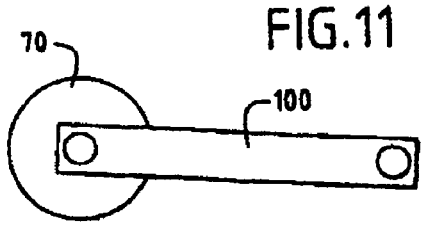
Figure 12:
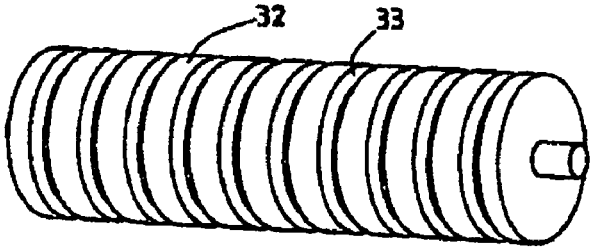
Figure 13:
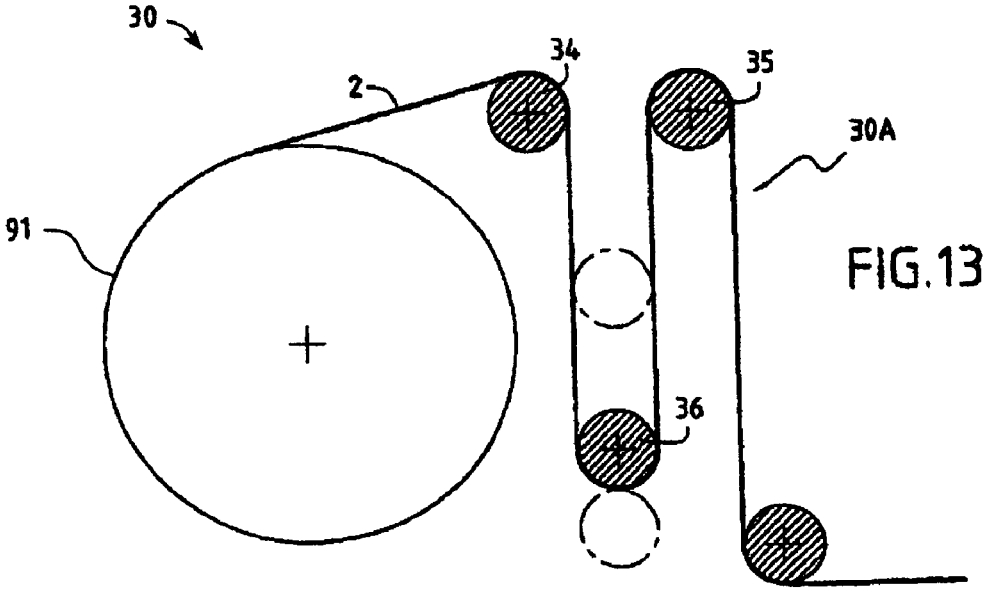
Figure 14:
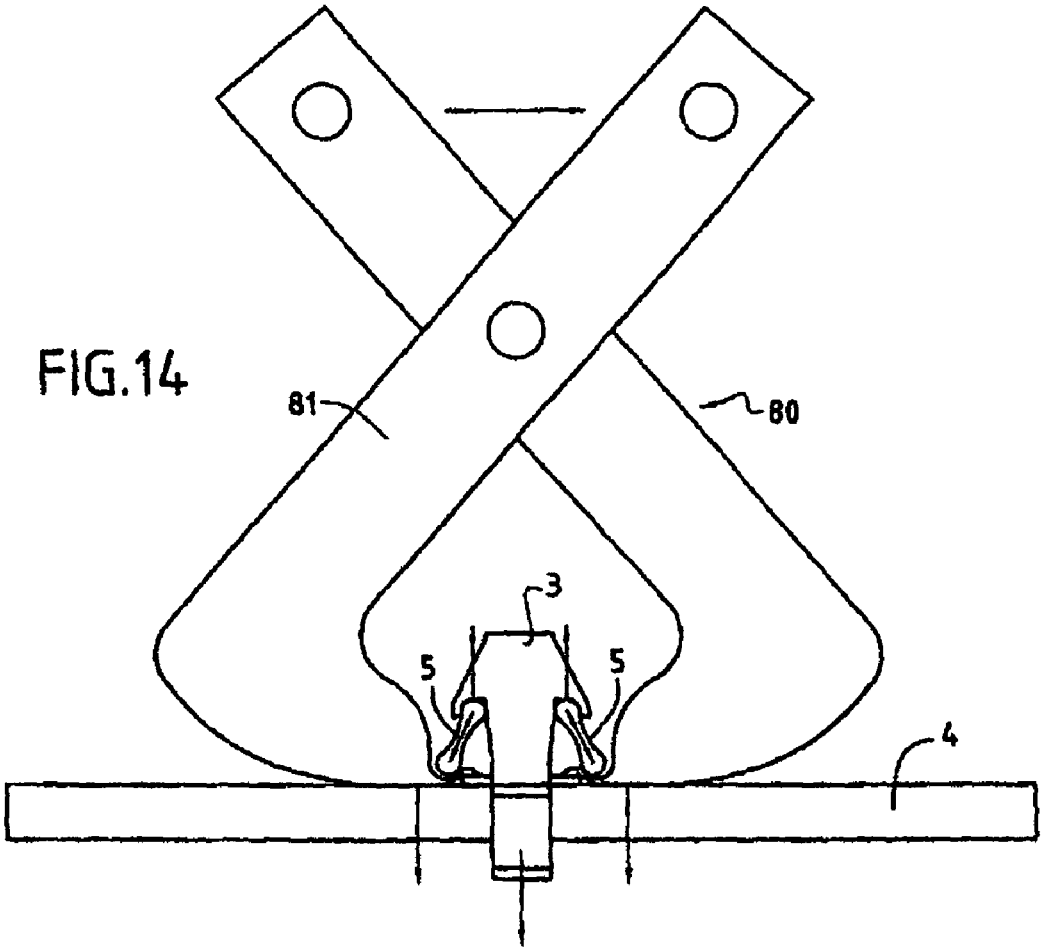
Figure 15:
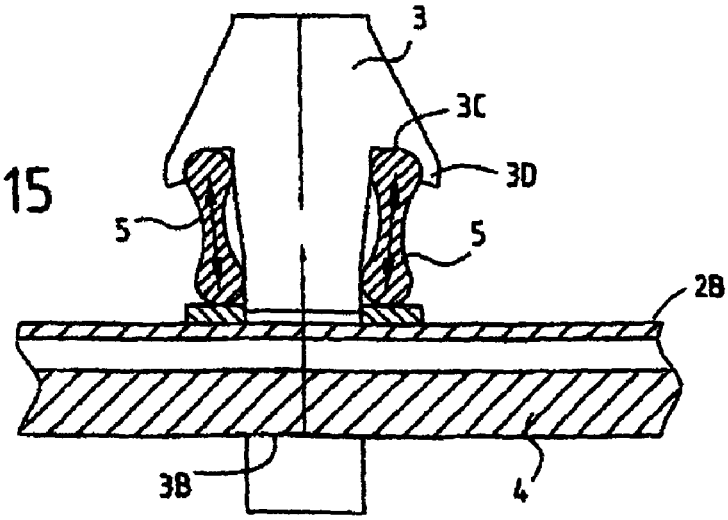

The invention can be understood based on the description provided hereafter as a non-limiting example and the drawing attached hereto that schematically shows:

FIG. 1: an installation to implement the process,
FIG. 2: an installation detail,
FIG. 3: a filtering wall,
FIG. 4: a representation of the mesh deformation,
FIG. 5: a connection means or clamp,
FIG. 6: a section of a pressure bar,
FIG. 7: a section of a support bar,
FIG. 8: a pressure bar installation station,
FIG. 9: a close up view of a detail in FIG. 8,
FIG. 10: a front view of the roller,
FIG. 11: a side view of the roller,
FIG. 12: a perspective view of the backing roller,
FIG. 13: a means of pre-tensioning,
FIG. 14: a detail of the support bars' installation,
FIG. 15: a section view of the completed assembly.

DETAILED DESCRIPTION OF THE INVENTION

By referring to the drawing, one sees a lining and filtering wall hereinafter referred to as filtering wall (1) for clarity, and intended to equip an expendable form.

The filtering wall (1) acts as a filter and depending on the size of panels (102), allows excess humidity to escape.

Typically, the filtering wall (1) includes a mesh (2) formed by assembling flexible warp strands comprised of the more resistant warp strands (2A), regular warp strands (2B), and weft strands (2C), with the mesh (2) being tensioned on a shape-retaining structure (90). It is understood that the term shape-retaining is not to be taken literally, but rather in the sense that the deformation related to the tension is extremely low.

This filtering wall (1) is then attached to a bearing structure ( ) not shown) in order to establish an expandable form and from which other filtering walls (1) can be linked to.

According to a characteristic of the filtering wall (1):

more resistant warp strands (2A) are more resistant than the regular warp strands (2B), the mesh (2) being tensioned by traction exerted solely on the more resistant warp strands (2A), and it includes tension maintaining means (3, 4, 5) for maintaining the tension that associates the more resistant strands (2A) with the shape-retaining structure and created by the cooperation of linking means (3) acting as a clamp of sort; pressure bars (4); and support bars (5) which, together with the mesh (2), delimit a larger panel (102) than the one resulting from the initial interlacing of regular warp strands (2B), and weft strands (2C).

The tension and thus the deformation are determined between two consecutive tension-maintaining means (3, 4, 5). More precisely, the principle does not involve exerting tension between the ends of the mesh (2) then implementing the tension maintaining means (3, 4, 5), but on the contrary, fixing one end of the mesh (2) with the tension maintaining means (3, 4, 5), then exerting a tension force to fix the subsequent tension maintaining means (3, 4, 5).

By pressing on these new fixed points, one exerts a new tension, thereby locking the mesh (2) with the tension maintaining means (3, 4, 5) and so on.

By proceeding this way, one obtains the same tension in each panel (102), thereby defining the size of the panels (102).

Since the tension exerts on the more resistant warp strands (2A), the single warp strand (2B) and the weft strands (2C) located in the previously defined panel (102) will arrange themselves based on an iso-stressed distribution as shown in FIG. 4.

The panel (102) is defined by four points A1, A2, B1 and B2 before it is tensioned. When one only pulls points B1 and B2 towards B'1 and B'2, the weft strands (2C) deform (finer lines), bending with a neutral strand in the middle of the panel (102). This layout spreads the constraints decreasingly from the edge of the panel (102), which allows, under pressure, increasing deformations towards the center of the panel (102).

Under pressure from concrete, the liner side defined by a panel (102) is no longer flat but bulged out. This lets one optimize the quantity of filler then used to obtain a finished surface.

The value of the deformation is determined by the relationship between the elasticity of the more resistant warp strands (2A) compared to the regular warp strands (2B). So that each panel (102) is independent, the more resistant warp strands (2A) shall not be common to two side-by-side panels (102) and, consequently, the mesh (2) shall include pairs of resistant strands (2A). The distance between the more resistant warp strands (2A) in a pair will depend on the tension maintaining means (3, 4, 5).

These more resistant warp strands (2A) are either larger strands, made from another material or more generally comprised of a group of close-set strands.

The tension-maintaining means (3, 4, 5) include:

on one side of the mesh (2), pressure bars (4) that extend along one of the mesh's (2) axes, on the other side of the mesh (2), support bars (5) that extend perpendicularly to the direction of the pressure bars (4), and at the panel (102) corners, are the linking means (3) for connecting the pressure bars (4) and support bars (5) together thereby forming at these connection points a grip that blocks the mesh (2).

These pressure bars (4) and support bars (5) and connection means (3) constitute the shape-retaining structure (90). The mesh (2) is not installed on a pre-formed shape-retaining structure (90), but rather this shape-retaining structure (90) is formed at the same time as the filtering wall (1).

In order to improve the locking of the mesh (2) at the four corners of the panel (102), the pressure bar (4) can include grooves (4A).

The pressure bar (4) is triangular shaped and the outside face of the base is grooved (4A).

The pressure bar (4) has an axial cavity (4B) to make it flexible.

The support bars (5) are in pairs (i.e.; a linking means (3) holds one pressure bar (4) and two support bars (5).

Now we will describe in detail the linking means (3). Moreover it is specified that in order to prevent any risk of disorder caused by the elements coming unfastened during transportation, this system may be completed by a positive locking system, bonding or welding. The connection means (3) appears as a clamp intended to overlap the pressure bar (4) and includes two legs (3A) with a stop face (3B) for the pressure bar (4) and, on the outside, on each of the arms' (3A) outside faces, a support surface (3C) for the support bars (5). The pressure bar (4) slides between the legs (3A). A bolt (3D) prevents the support bars (5) from sliding laterally. The bolt (3D), formed by a bump, is next to one of the support surfaces (3C). The support bar (5) is loaded by rotating around its base.

Therefore, to this end, one will note that this support bar (5) has rounded faces and is flexible so it can deform elastically. Viewed as a section, it is shaped like a figure eight. Potential cavities provide the desired compressibility. This is also an advantage because these pressure bars (4) and support bars (5) can be delivered wound on a reel.

During fabrication, one will use the linking means (3) and support surface (3C) as a tooth to advance the filtering wall (1). It should be noted that the legs (3A) ends are equipped with lateral notches (3E) to attach to a "Tor" iron bar on the form-bearing structure.

To fabricate the filtering wall (1), one uses a set of means. These means include:

- a mesh (2) wound around a shaft serving as a supply source (20),
- ahead of this supply source (20), a tensioning assembly (30), and
- a positioning assembly (40) to install the shape-retaining structure (90).

A cutting station (50) set at the appropriate length is provided ahead of the filtering wall (1) assembly stations.

The shape-retaining structure (90) is installed progressively by positioning the connecting means (3) on the tensioned mesh (2) and then installing the pressure bar (4) followed by the support bars (5).

The tensioning assembly (30) are divided into two tensioning zones (30A and 30B) that are spread on both sides of a tool (41). One is placed just behind the mesh (2) wound on its supply source (20) and the other, even with the equipped and thus completed mesh (2).

The tensioning assembly (30) exerts a traction force on the mesh (2), which is locked in a straight line by one of the tool's (41) systems. The traction force is determined by the number of panels (102) between the two tensioning zones (30A, 30B) in proportion to the desired lengthening of one panel (102).

The straight-line locking of the mesh (2) located in the pre-tensioning zone (30B) includes a roller (31) and a backing roller (32), each equipped with grooves (33) so the linking means (3) can pass freely.

The roller (31) and backing roller (32) pinch the mesh (2). A drive system (e.g.; by constant torque) is used to apply a constant pre-determined force on the warp strands (2A, 2B).

The roller (31) and backing roller (32) are motorized and can advance the mesh (2) progressively.

The roller (31) and/or backing roller (32) can be comprised of cable rollers (70) aligned on a shaft. The cable roller (70) is mounted in addition on arms (100).

The outside face of the cable rollers (70) and/or roller (31) and backing roller (32) will be in material that can be deformed elastically so that it engages the mesh (2) sufficiently. The diameter will be defined to engage a sufficient length of the mesh's (2) surface. In the pre-tensioning zone (30A), in a preferred form of advancing and tensioning the mesh (2), the tensioning assembly (30) is comprised of a set of two fixed rollers (34, 35) between which a mobile roller (36) is located between two positions (dotted lines), one upper position that starts unwinding a mandrel (91) the mesh (2) is wound on and the other lower position that stops the mandrel's (91) unwinding. The mesh (2) then forms a "V". The pre-traction force on the mesh (2) is provided either by the simple weight of the mobile roller (36) or this weight is completed by springs or other traction means like jacks, etc. The tension is then determined by the means spread out ahead of the tool (41).

After the pre-tensioning zone (30A), which in particular controls the unwinding of the mesh (2) from the supply source (20) it is wound on, there is a mesh (2) advance system and a linking means (3) installation system. This installation system consists of wheels (42) spread along an axis transverse to the mesh's (2) direction of movement.

There are as many wheels (42) as linking means (3) to be positioned transversally.

All of the wheels (42) are united in rotation and driven by a suitable irreversible system (e.g.; a stepper motor) that authorizes one rotation corresponding to a step of the mesh (2).

Each wheel (42), whose circumference is a multiple of the panels' (102) step, includes evenly spaced notches (43) that can accommodate the head of each linking means (3).

Laterally to these wheels (42) and in the area of the notches (43), the system includes guides (44) for the pressure bars (4) that must be introduced in the linking means (3) heads. Therefore these guides (44) present a groove (45) whose shape is complementary to the outside of the pressure bars (4). In fact, the guides (44) are also used to assemble the wheels (42) together.

To introduce the pressure bars (4), the linking means (3) have to be pre-aligned because the mesh (2) and the shape of the notches (43) do not hold them adequately.

To this end, the machine includes an alignment system (46) to align all of the linking means (3) located on an axis.

This alignment system (46) includes an axle (47) on which are mounted pairs of spread disks (48), each pair of disks (48) being designed to laterally wedge a linking means (3) and that part of the axle (47) located between a pair of disks (48) so as to fit partially between the legs (3A). One sees that these disks (48) have beveled sides (49) to facilitate centering the linking means (3). Teeth (60) driven by the wheels (42) are used to position, advance and immobilize the mesh (2) on the disks (48). The linking means (3) are installed by the bottom in the installation shown. This way one obtains a position along the two axes the time it takes to introduce the pressure bar (4) that comes from a section wound on a drum.

The pressure bar (4) is fed as follows.

Cable rollers (70) drive the section from a reel (69) up to the first stop (71).

When the alignment system (46) is in position, the first stop (71) is retracted and the cable rollers (70) push the pressure bar (4) through the linking means (3), guided by the guides (44), up to the second stop (72).

The pressure bar (4) is then cut and the first stop (71) is then put back in position.

As the pressure bars (4) are positioned, the support bars (5) have to be installed.

To do this, the support bars (5), wound on a reel (120), are progressively unwound flat and then pivoted 90° to until they are anchored in a freestanding position on the linking means (3).

The machine will then include a system to progressively unwind the support bars (5) and a means to position them.

Initially, the support bars (5) are guided so that they press against the linking mean's (3) support surfaces. The two support bars (5) then form a "V".

A mechanical means, which, in a preferred embodiment is in the form of a grip (80) causes the support bars (5) to tip towards the linking means (3). The grip (80) has two jaws (81) closing in together.

By elastically deforming the pressure bar (4) and support bars (5), one then positions the support bars (5) in a freestanding position and grips the mesh (2). One sees that the action/reaction forces exerted on the support bars (5) are inclined vis-à-vis the linking means (3) median axis. As such, based on continuous elements mesh (3), support bars (5) and pressure bar (4)), one can create a filtering wall (1) of suitable length that is only cut at the end of the assembly operation.

According to the fabrication process for a filtering wall (1):

one stretches a mesh (2) between two tension zones (30A, 30B) by exerting traction along more resistant warp strands (2A) and regular warp strands (2B), one positions the linking means (3) at certain points of the mesh (2) to delimit the panels (102), one aligns the linking means (3), one inserts, by sliding, the pressure bar (4) through the stop face (3B), one positions the support bars (5) supported on the support surfaces (3C), one tips the support bars (5) towards the linking means (3) median axis to form the grips with the linking means (3) and pressure bar (4), and one constitutes the filtering wall (1) continuously and progressively and then one cuts the filtering wall (1) to the desired dimensions.

The filtering wall (1) is then joined to a bearing structure to create an expendable form.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A filtering wall for an expendable form comprised of a mesh formed by assembling warp strands, and weft strands, said mesh being stretched on a shape-retaining structure;

said filtering wall being characterized so that said warp strands being subdivided into more resistant warp strands and regular warp strands, said mesh's tension being created by traction solely on the more resistant warp strands, and including tension-maintaining means associating said more resistant warp strands with said shape-retaining structure, said tension-maintaining means delimiting a larger panel than the one resulting from the initial crossing of said warp and weft strands.

2. A filtering wall for an expendable form according to claim 1, characterized in such a way that said tension-maintaining means include:

on one side of said mesh, pressure bars extending along one of said mesh's axes, on the other side of said mesh, support bars extending perpendicularly to the direction of said pressure bars, and at the panel corners, linking means connecting said bars together thereby forming at these connection points a grip blocking said mesh.

3. A filtering wall for an expendable form according to claim 2, characterized in such a way that said pressure bar being triangular in shape and said outside face of base being grooved.

4. A filtering wall for an expendable form according to claim 3, characterized in such a way that said pressure bar having an axial cavity so as to make it flexible.

5. A filtering wall for an expendable form according to claim 2, characterized in such a way that said linking means being shaped like a two-leg clamp with a stop on one side for said pressure bar and, on the outside, on each of said legs' outside faces, a support surface for said support bars.

6. A filtering wall for an expendable form according to claim 5, characterized in such a way so that a bolt is preventing said support bars from sliding laterally.

7. A filtering wall for an expendable form according to claim 1, characterized in such a way that said bolt being formed by a bump next to one of said support surfaces.

8. A filtering wall for an expendable form according to claim 5, characterized in such a way that ends of said legs being equipped with lateral notches to attach to a "Tor" iron bar on a form-bearing structure.

9. Fabrication process for a filtering wall according to claim 1, characterized in such a way that one constitutes said filtering wall continuously and progressively and then one cuts said wall to the desired dimensions.

* * * * *